United States Patent [19]

Foulds et al.

[11] Patent Number: 4,868,152

[45] Date of Patent: Sep. 19, 1989

[54] SELF-ADHESIVE LABEL ASSEMBLY

[75] Inventors: Anthony G. Foulds, Rome, Italy; Lekha Bakrania, Luton, United Kingdom

[73] Assignee: The Wiggins Teape Groups Limited, Basingstoke, United Kingdom

[21] Appl. No.: 170,345

[22] Filed: Mar. 18, 1989

[30] Foreign Application Priority Data

Mar. 20, 1987 [GB] United Kingdom ..... 8706667

[51] Int. Cl.[4] ..... B41M 5/16

[52] U.S. Cl. ..... 503/212; 427/150; 428/40; 428/914; 503/200; 503/215; 503/225; 503/226

[58] Field of Search ..... 428/913, 914, 40; 503/200, 215, 226, 225, 212

[56] References Cited

U.S. PATENT DOCUMENTS

| | | | |
|---|---|---|---|
| 3,516,846 | 6/1970 | Matson | 503/200 |
| 3,516,941 | 6/1970 | Matson | 503/2 |
| 3,672,935 | 6/1972 | Miller et al. | 503/225 |
| 3,773,542 | 11/1973 | Hayashi et al. | 503/225 |
| 3,843,383 | 10/1974 | Ishige et al. | 503/216 |
| 4,121,856 | 10/1978 | Brunette | 282/1 R |

FOREIGN PATENT DOCUMENTS

| | | | |
|---|---|---|---|
| 0017386 | 10/1980 | European Pat. Off. | 503/226 |
| 1042596 | 9/1966 | United Kingdom | 503/226 |
| 1042597 | 9/1966 | United Kingdom | 503/200 |
| 1042598 | 9/1966 | United Kingdom | 503/200 |
| 1042599 | 9/1966 | United Kingdom | 503/217 |
| 1107960 | 3/1968 | United Kingdom | 503/226 |
| 2172022 | 9/1986 | United Kingdom | 503/209 |

*Primary Examiner*—Bruce H. Hess

*Attorney, Agent, or Firm*—Burns, Doane, Swecker & Mathis

[57] ABSTRACT

A phenol-formaldehyde color developing resin is used as a partial or complete replacement for the acidic clay color developer hitherto used in loaded self-copying papers for self-adhesive label assemblies. This counteracts desensitization of the backing paper by the adhesives typically used in such assemblies.

8 Claims, 1 Drawing Sheet

SELF-ADHESIVE LABEL ASSEMBLY

Figure 1:
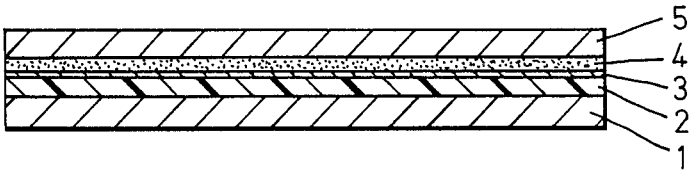

This invention relates to a self-adhesive label assembly comprising self-adhesive label material peelably adhered to a pressure-sensitive self-copying paper backing. Such label assemblies may take various forms, and a variety of these are disclosed, for example, in U.K. Patent No. 1,107,960.

Self-copying pressure-sensitive papers are copying papers in which all the reactants needed to produce a copy on exposure to imaging pressure are carried by a single ply of paper. They are to be contrasted with the more widely used transfer pressure-sensitive copying papers in which an image is formed on transfer of reactant from an upper sheet to a lower sheet with which it is in contact.

U.K. Patent No. 1,107,960 explicitly discloses the use of a backing paper containing two colourless chemicals which react on contact with one another to produce a coloured imaging material, but which are normally isolated from each other in the paper. This is achieved by one of the chemicals being present in solution in microcapsules which are ruptured by imaging pressure so as to release the chemical into contact with the other reactive chemical in the paper and so produce an image corresponding to the pattern of the pressure applied. Such a paper is disclosed in more detail in U.K. Patent No. 1,042,599.

U.K. Patent No. 1,107,960 discloses that the preferred self-copying paper backing is "ACTION" brand carbonless paper ("ACTION" is a trade mark). At the time U.K. Patent No. 1,107,960 was applied for, "ACTION" brand carbonless paper employed a di-thioxamide derivative and a metal rosinate as the colour-generating reactants. In recent years, however, the reactants employed in "Action" brand carbonless paper as manufactured in Europe by Wiggins Teape have been changed, and an acid clay/encapsulated electron-donating colour former reactant combination is now used. Both reactants are present as a loading within the paper as a result of having been present in the stock from which the paper is made. Whilst the use of an acid clay/electron donating colour former reactant combination affords excellent imaging properties for the great majority of uses to which "ACTION" brand carbonless paper may be put, it has been found that its copy-generating capabiliy may be impaired when used as a backing paper for label material coated with certain types of adhesive compositions, for example low molecular weight rosin-based adhesives.

It has now been found that this drawback may be overcome or at least reduced if a phenol-formaldehyde colour developing resin is employed as a partial or complete replacement for the acid clay reactant used hitherto. Whilst the use of such a resin as a loading in a self-contained copying paper has been proposed before (see U.S. Pat. No. 3,672,935, View VIII of FIG. 2 and the associated description), such a paper has never been produced commercially, so far as the present applicants are aware, and it had not previously been appreciated that the use of such a paper as a label backing paper would be beneficial.

Accordingly, the present invention provides a self-adhesive label assembly comprising self-adhesive label material peelably adhered to pressure-sensitive self-copying paper of which the image-generating reactants are:

(a) electron donating colour former material contained in microcapsules which are present as a loading within the thickness of the paper; and (b) an acidic colour developing material; characterized in that the acidic colour developing material comprises a phenol-formaldehyde resin.

Suitable phenol-formaldehyde resins may be as disclosed in U.S. Pat. No. 3,672,935 referred to above, and are preferably alkyl- or phenyl-substituted. Para-substituted phenol-formaldehyde resins are preferred, for example p-phenyl-, p-octyl-, p-nonyl-, or p-tertiary butyl-substituted phenol-formaldehyde resins. The phenol-formaldehyde resins may be zincated, e.g. by reaction of zinc with the resin or by the inclusion of zinc salts (zincation is well-known in the art, and as is disclosed, for example, in U.S. Pat. Nos. 3,723,156 and 3,732,120). Modification of the resin by metals other than zinc is also possible. The phenol-formaldehyde resins may include a proportion of an aromatic carboxylic acid, for example salicylic acid or a salicylic acid derivative, as disclosed, for example, in U.S. Pat. No. 4,612,254. Alternatively, the phenol-aldehyde resin may include a co-condensed trifunctional or higher phenol, as disclosed in U.K. Patent Application No. 2,073,226A. The phenol-formaldehyde resin may be present as a loading within the thickness of the paper as a result of incorporation of the resin into the papermaking stock from which the paper is made. Alternatively, or in addition, the phenol-formaldehyde resin may be applied as an aqueous dispersion by a coating technique. Use of a size press or size bath on the papermachine used to produce the paper is advantageous for this purpose as it applies the dispersion to both sides of the paper and does not involve use of an off-machine coater. This latter alternative is particularly suitable for incorporation of phenol-formaldehyde resins which are available in emulsion form, as opposed to the solid particulate form in which such resins have historically been used. When applied as a dispersion at the size press or size bath, the dispersion normally soaks into the paper, and the resin colour developing material is thereby carried into close proximity with the encapsulated colour former.

Besides facilitating the production of label assemblies in which more intense and hence more legible copies may be produced, the present invention enables a wider range of pressure-sensitive adhesives to be used than hitherto. It also reduces the stringency of the precautions which the label manufacturers must take to minimise desensitization of the label assemblies.

The phenol-formaldehyde resin may be the only colour developing material present in the self-copying paper backing, or may be used in combination with a conventional acid clay colour developing material loading within the sheet, typically an acid washed dioctahedral montmorillonite clay colour developing material as disclosed in U.S. Pat. No. 3,753,761.

The electron-donating colour former material may be a blend of colour formers as conventionally used in pressure-sensitive copying papers. Such colour formers are very widely disclosed in the patent literature and so will not be discussed extensively herein. By way of example, the electron-donating colour formers may be phthalide derivatives, such as 3,3-bis(4-dimethylaminophenyl)-6-dimethylaminophthalide (CVL) and 3,3-bis(1-octyl-2-methylindol-3-yl)phthalide, or fluoran derivatives, such as 2'-anilino-6'-diethylamino-3'methylfluoran, 6'-dimethylamino-2'-(N-ethyl-N-phenylamino- 4'-methylfluoran), and 3'-chloro-6'-cyclohexylaminofluoran.

The solvents used to dissolve the colour former material may also be as conventionally used in pressure-sensitive copying papers. These materials are also widely disclosed in the patent literature. Examples of suitable solvents are partially hydrogenated terphenyls, alkyl naphthalenes, diarylmethane derivatives, dibenzyl benzene derivatives, alkyl benzenes and biphenyl derivatives, optionally mixed with diluents or extenders such as kerosene.

The colour former solution may be encapsulated by encapsulation processes conventional in the art, particularly processes which give rise to microcapsules having walls of synthetic polymer material, for example aminoplast material. Examples of such processes are those disclosed in U.S. Pat. Nos. 3,516,846; 3,516,941; 4,001,140; and 4,105,823.

Figure 2:
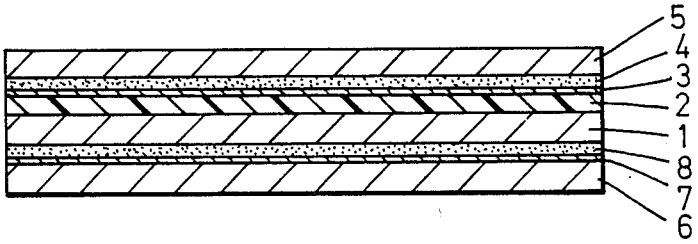

Examples of self-adhesive label assembly constructions which are known in themselves but to which the invention may advantageously be applied are shown in the accompanying drawings, in which:

FIG. 1 is a diagrammatic end view (not to scale) of a self-adhesive label assembly incorporating a self-copying pressure-sensitive backing paper; and FIG. 2 is a diagrammatic end view (not to scale) of a double self-adhesive label assembly incorporating two self-copying pressure-sensitive backing paper plies.

Referring first to FIG. 1, a self-copying backing paper ply 1 of "ACTION" brand carbonless paper carries on one surface an extruded polyethylene release coating 2, e.g. at a coatweight of about 20 g $m^{-2}$. The polyethylene coating 2 itself carries a subsequently applied thin silicone coating 3, e.g. at a coatweight of about 0.3 g $m^{-2}$ (dry). This silicone coating serves to enhance the release characteristics of the polyethylene coating 2. A layer of pressure-sensitive adhesive 4 is applied to the silicone coated polyethylene surface at a wet coatweight giving rise to a dry coatweight of about 20 g $m^{-2}$. After drying, a bond paper label stock ply 5 is laminated to the adhesive coating 4. The polyethylene coating 2 is subjected to corona-discharge or spark-perforation treatment prior to the application of the silicone and adhesive coatings, in order to provide a key for those coatings.

In the assembly just described, the adhesive coating 4 is not in direct contact with the backing paper, by virtue of the presence of the silicone-coated polyethylene ply 2. However, the silicone-coated polyethylene coating has been found to be permeable to the adhesive to some extent, presumably as a result of the corona-discharge or spark-perforation treatment of the polyethylene coating and the thinness of the silicone coating.

Referring now to FIG. 2, there is shown a construction in which the self-copying backing paper ply is itself adapted for use as a label. The plies or coatings 1 to 5 of this assembly are as described with reference to the assembly of FIG. 1. The assembly of FIG. 2 includes a further backing paper ply 6 carrying a release coating 7, e.g. a silicone release coating. The release coating itself carries an adhesive coating 8.

The release- and adhesive-coated backing paper ply 6 is directly laminated to the underside of the self-copying backing paper ply 1. The adhesive coating 8 is therefore in direct contact with the self-copying backing paper.

When the bond paper labels 5 of either of the above-described assemblies are subjected to imaging pressure, a copy image is produced on the backing paper ply 1, which thus provides a permanent record of the information carried on the labels 5. The label 5 and its associated adhesive coating 4 may be peeled away from the self-copying backing paper ply 1, by virtue of the silicone and polyethylene release coatings on the ply 1, and may then be applied to an object to be labelled. In the case of the assembly shown in FIG. 2, the backing paper ply 1, and its associated adhesive coating 8 may itself be peeled away from the release-coated backing paper ply 6 and may then be applied to some other surface, either as a copy label or as part of a record system.

The invention will now be illustrated by the following Examples, in which all parts and percentages are by weight unless otherwise stated:

EXAMPLE 1

A series of self-contained copying paper handsheets was first made up by the following procedure in each case.

180 g of a 3% consistency aqueous suspension of woodpulp fibres was diluted with 820 ml de-ionized water, and 4.1 g of an approximately 25% solids content aqueous suspension of microcapsules were added. The microcapsules were produced by a process as described in U.K. Patent No. 1,507,739, and contained a conventional black-copy electron- donating colour former formulation in a conventional partially hydrogenated terphenyl/alkyl benzene mixed solvent composition. Acidic colour developer material as specified below was then added, and the mixture was stirred for 15 minutes. 4.0 g of 0.05% aluminium sulphate solution was then added. The resulting papermaking stock was then used to produce round handsheets of approximately 15 cm diameter and approximatey 60 g $m^{-2}$ grammage.

The colour developer materials used were an acid-washed dioctahedral montmorillonite acidic clay ("Silton" AC/PC supplied by Mizusawa Industrial Chemicals Ltd. of Osaka, Japan) and a 46.5% solids content zinc-modified phenol-formaldehyde resin aqueous emulsion ("Durez" 32131 resin, supplied by Occidental Chemical Corporation, of Niagara Falls, New York State, USA and believed to be as disclosed in U.S. Pat. No. 4,612,254). These materials were each used alone and in two different blends as follows:

| | Mix 1 | Mix 2 | Mix 3 | Mix 4 |
|---|---|---|---|---|
| Acidic clay (g) | 0.4 | 0.4 | 0.2 | — |
| 46.5% Resin emulsion (g) | — | 0.43 | 0.86 | 0.86 |

The image-generating capability of the resulting handsheets was investigated by a dot matrix block imaging test. In this test, an Epson dot matrix printer was used to produce a 4 cm × 12 cm solid block image on a 60 $gm^{-2}$ bond paper/test handsheet couplet, and the % reflectance of the block copy image (as compared with a white standard) was measured after 1 minute and after 24 hours. The reflectance value obtained is a measure of the imaging capability of the paper (the lower the reflectance value, the more intense the image). The results obtained for the various test papers were as shown in Table 1*a* below (the numbering of the paper corresponds to that of the mix from which it was produced):

It will be seen that the reflectance value for Paper 1, which contained only acidic clay colour developer did not change over the test period (1 minute to 24 hours). By contrast, Papers 4 and 3, which contained only resin, or contained a high proportion of resin relative to acidic clay, showed a marked increase in image development over the test period. Paper 2, which contained a high proportion of acidic clay relative to resin, showed some increase in image development over the test period, but it was not nearly as great as for Papers 3 and 4. It is thought that these effects are due to the use of a colour former solution of a kind conventional for use with an acidic clay colour developer rather than a colour former solution specially designed for use with a phenol-formaldehyde resin colour developer. Had the latter been used, it would have been expected to give just as rapid colour development with the phenol-formaldehyde resin colour developer as was observed with the acidic clay colour developer.

Fresh self-copying paper handsheets were then laminated (wire-side down) by hand pressure on to sheets of polyethylene which had been coated with a conventional pressure-sensitive adhesive of a kind often used in self-adhesive labels. The polyethylene sheets served merely as a carrier which enabled the effect of the adhesive to be evaluated, proper label stock not being readily available. The adhesive coating was applied to the polyethylene sheets by means of a laboratory Meyer bar coater, and extended over only part of the sheets, such that part of the self-copying paper was in contact with adhesive and part was not. The laminates were then subject to an artificial ageing process intended to simulate in accelerated fashion the effect of storage of the product, prior to its being imaged (in normal circumstances, the product is likely to be stored in a warehouse or stock room for some time before it is actually used for labelling). The exposed surface of the self-copying sheet of the laminate was then imaged in a block configuration by means of a dot matrix printer such that the image straddled the boundary between the adhesive-carrying and adhesive-free portions of the laminate. The dot matrix printer used and the image dimensions were as described above for the unlaminated handsheets. The reflectance of the copy image produced on the adhesive-carrying and adhesive-free portions of the self-copying paper in the laminate was then determined one minute, thirty minutes and 24 hours after the imaging operation.

The results obtained were as shown in Table 1*b* below:

TABLE 1b

| Time after Imaging | Contact with Adhesive (No/Yes) | Reflectance (%) Paper 1 | D | Paper 2 | D | Paper 3 | D | Paper 4 | D |
|---|---|---|---|---|---|---|---|---|---|
| 1 min. | No | 38 | | 36 | | 34 | | 33 | |
| | Yes | 40 | 2 | 35 | 1 | 34 | 0 | 33 | 0 |
| 30 min. | No | 36 | | 31 | | 27 | | 25 | |
| | Yes | 40 | 4 | 31 | 0 | 28 | 1 | 26 | 1 |
| 24 hours | No | 35 | | 28 | | 25 | | 23 | |
| | Yes | 44 | 9 | 32 | 4 | 28 | 3 | 25 | 2 |

D (in this and subsequent Examples) = Difference in reflectance values between parts of paper in contact with and not in contact with adhesive.

It will be seen that for the areas of the self-copying paper which were not in contact with adhesive, there was a steady increase in image intensity over the 24 hours development period. This generally paralleled that observed with the unlaminated handsheets (see Table 1a above). By contrast, the areas of the Paper 1 (acidic clay developer only) which had been in contact with the adhesive showed a decline in image intensity over the 24 hours development period. For Paper 2 (same quantity of acidic clay colour developer but resin colour developer present as well), there was a slight increase in image intensity over the development period, although this was not as marked as that observed in the absence of adhesive. For Paper 3 (smaller amount of acidic clay and greater proportion of resin), and Paper 4 (resin colour developer only) there was a substantial increase in image intensity over the development period (almost as great as in the portion of the Papers which were not in contact with adhesive). These results demonstrate the beneficial effect on image intensity of replacing all or part of the acidic clay colour developer by a phenol-formaldehyde resin colour developer.

The effect may also be seen by comparison of the D values for the various papers. For Paper 1 (clay only) the D values are higher than for the other papers, i.e. contact with adhesive affects the clay colour developer more than resin colour developer. The D values for Papers 2 to 4 decreased as the proportion of resin relative to clay increased.

EXAMPLE 2

This illustrates the use of an alternative phenol-formaldehyde resin colour developer, namely a non-zincated p-phenylphenol-formaldehyde resin supplied as a 40% solids content aqueous emulsion by Mitsui Toatsu Chemicals of Tokyo, Japan under the designation "RBE-40". The procedure employed was generally as decribed in Example 1, except that the quantities of colour developer materials used to make handsheets were as follows:

| | Mix 1 | Mix 2 | Mix 3 |
|---|---|---|---|
| Acidic clay (g) | 0.4 | 0.4 | 0.4 |
| 40% Resin emulsion (g) | — | 0.25 | 0.5 |

The reflectance values obtained after dot-matrix block imaging the laminated handsheets were as shown in Table 2 below:

TABLE 2

| Time after Imaging | Contact with Adhesive (No/Yes) | Reflectance (%) Paper 1 | D | Paper 2 | D | Paper 3 | D |
|---|---|---|---|---|---|---|---|
| 1 min. | No | 44 | | 40 | | 39 | |
| | Yes | 48 | 4 | 42 | 2 | 42 | 3 |
| 10 min. | No | 42 | | 35 | | 35 | |
| | Yes | 44 | 2 | 37 | 2 | 36 | 1 |
| 1 hour | No | 39 | | 34 | | 34 | |
| | Yes | 45 | 6 | 36 | 2 | 34 | 0 |
| 24 hours | No | 37 | | 35 | | 32 | |
| | Yes | 47 | 10 | 37 | 2 | 34 | 2 |

It will be seen that with paper 1 (acidic clay colour developer alone), the image intensity obtained from the portion of the paper in contact with adhesive was reduced compared with that obtained from the portion of the paper not in contact with adhesive. With Papers 2 and 3 (containing a proportion of resin colour developer) the loss of image intensity as a result of the presence of adhesive was much reduced. The D value for Paper 1 after 24 hours development was much higher than the D values for Papers 2 and 3. These results demonstrate the beneficial effects on image intensity of including at least a proportion of phenol-formaldehyde resin colour developer in the paper.

EXAMPLE 3

This illustrates size press application of a phenol-formaldehyde colour developing resin emulsion to a just-produced self-copying paper carrying a loading of microencapsulated electron-donating colour former material and acid clay colour developing material.

The paper was produced in conventional manner, without internal sizing, on a Fourdrinier papermachine at a nominal grammage of 50 g $m^{-2}$. The microcapsules were as described in Example 1 and were present in an amount of 10% on a dry microcapsule/dry paper basis. The acid clay was an acid-washed dioctahedral montmorillonite clay supplied as "Copisil" D4A10 by Süd-Chemie A.G. of Munich, Federal Republic of Germany and was present in an amount of 4.2% on a dry clay/dry paper basis.

The size press formulation was a conventional starch-based surface sizing formulation except that it contained approximately 6.7% of 40% solids content phenol-formaldehyde emulsion as used in Example 2 (i.e. about 2.7% resin on a dry basis). The size press pick-up was approximately 1 to 1.5 g $m^{-2}$(wet), giving a phenol-formaldehyde resin content in the paper of approximately 2.5 to 3.0% on a dry resin/dry paper basis.

Samples of the resulting paper and of a control paper containing no phenol-formaldehyde resin but a higher proportion (about 6%) of acid clay, were made into laminates as described in Example 1 and tested, and the results obtained were as follows:

| Time after Imaging | Contact with Adhesive (No/Yes) | Reflectance (%) Invention | D | Control | D |
|---|---|---|---|---|---|
| 1 min | No | 40 | | 38 | |
| | Yes | 54 | 14 | 54 | 16 |
| 2 hours | No | 32 | | 33 | |
| | Yes | 47 | 15 | 52 | 19 |
| 18 hours | No | 31 | | 35 | |
| | Yes | 44 | 13 | 50 | 15 |

Reflectance values of about 50 or more are indicative of the absence or near-absence of image formation. It will be seen that the paper according to the invention gave an adequately legible image after 18 hours contact with adhesive, whereas the control paper gave a barely visible image, despite having a higher proportion of colour developing clay. The D values also demonstrate that the resin-containing paper has a better resistance to desensitization when in contact with adhesive.

EXAMPLE 4

The procedure generally decribed in Example 3 was repeated, except that a zinc-modified phenol-formaldehyde resin aqueous emulsion as described in Example 1 was used in place of the resin emulsion used in Example 3. The content of acid-washed dioctahedral montmorillonite clay in the paper was 5.9% by weight on a dry clay/dry paper basis, i.e. slightly higher than in Example 3. The resin content of the size press mix was 2.1% on a dry basis, i.e. slightly lower than in Example 3. The amount of resin applied to the paper was found by analysis to be 0.6 g $m^{-2}$ total, i.e. about 0.3 g $m^{-2}$ per side.

Samples of the resulting paper and a control paper also containing 5.9% acid-washed dioctahedral montmorillonite clay were tested as described in Example 3, and the results were as follows:

| Time after Imaging | Contact with Adhesive (No/Yes) | Reflectance (%) Invention | D | Control | D |
|---|---|---|---|---|---|
| 1 min | No | 38 | | 42 | |
| | Yes | 40 | 2 | 50 | 8 |
| 15 min | No | 34 | | 36 | |
| | Yes | 37 | 3 | 45 | 9 |
| 2 hours | No | 31 | | 34 | |
| | Yes | 35 | 4 | 44 | 10 |
| 12 hours | No | 30 | | 35 | |
| | Yes | 35 | 5 | 43 | 8 |

The D values for the resin-containing paper were significantly better than for the control paper.

Further laminate samples, made at the same time as those just referred to, were tested 70 days later (so giving an indication of the effect of long periods of storage of label assemblies before use), and the results were as follows:

| Time after Imaging | Contact with Adhesive (No/Yes) | Reflectance (%) Invention | D | Control | D |
|---|---|---|---|---|---|
| 1 min | No | 40 | | 44 | |
| | Yes | 44 | 4 | 55 | 11 |
| 15 min | No | 34 | | 38 | |
| | Yes | 37 | 3 | 48 | 10 |
| 9 hours | No | 30 | | 34 | |
| | Yes | 37 | 7 | 48 | 14 |
| 24 hours | No | —* | | —* | |
| | Yes | 37 | — | 48 | — |

*No measurements made

The D values obtained with the resin-containing paper, and the final intensity values, were very much better for the resin-containing paper than for the control paper.

EXAMPLE 5

This illustrates the use of an alternative phenol-formaldehyde resin colour developer, namely a thermoplastic, zincated alkylphenol novolac resin dispension supplied under the designation HRJ-4023 by Schenectady de France, of Bethune, France (a subsidiary or associate company of Schenectady Chemicals, Inc. of Schenectady, New York State, USA). The resin is thought to be modified by the inclusion of a small proportion of salicylic acid or a derivative thereof.

Sheets of "ACTION" brand 50 g $m^{-2}$ carbonless copying paper of European manufacture were coated on one surface only by means of a laboratory coater with a starch-based size formulation containing approximately 8.2% of 35.7% resin dispersion as described above (i.e. about 3% resin on a dry basis). Control sheets were prepared in similar manner but using a size formulation containing no resin.

The resulting sheets were tested (after drying) in the manner described in previous Examples, and the results were as follows:

| Time after Imaging | Contact with Adhesive (No/Yes) | Reflectance (%) Invention | D | Control | D |
|---|---|---|---|---|---|
| 1 min | No | 40 | | 44 | |
| | Yes | 54 | 14 | 57 | 13 |
| 24 hours | No | 27 | | 35 | |

-continued

| Time after Imaging | Contact with Adhesive (No/Yes) | Reflectance (%) Invention | D | Control | D |
|---|---|---|---|---|---|
| | Yes | 45 | 18 | 50 | 15 |

Although the final intensity of the resin-containing paper was better than the control paper, the D values are in a reverse relationship to that in other Examples. It is possible that the reflectance results for the resin-containing papers are anomalous. Reflectance values for the same paper before laminating were 40 and 33 for 1 min. and 24 hours respectively, which suggests the value of 27 after 24 hours without adhesive contact may have been unrepresentative.

EXAMPLE 6

The procedure of Example 5 was repeated using a different phenolic resin, namely a zincated alkylphenol novolak resin dispersion supplied as "SMD 9910" by Schenectady Midland Limited, of Wolverhampton, United Kingdom (also a subsidiary or associate company of Schenectady Chemicals Inc., USA). The size formulation contained about 5.5% of 55% solids content resin dispersion, (i.e. about 3% resin on a dry basis).

The test results for the first set of sheets were as follows:

| Time after Imaging | Contact with Adhesive (No/Yes) | Reflectance (%) Invention | D | Control | D |
|---|---|---|---|---|---|
| 1 min | No | 40 | | 44 | |
| | Yes | 48 | 8 | 57 | 13 |
| 24 hours | No | 27 | | 35 | |
| | Yes | 40 | 13 | 50 | 15 |

It will be seen that the D values and final intensity values for the resin-containing paper are significantly better than for the control paper.

EXAMPLE 7

The procedure of Example 5 was repeated, with minor changes, using a further different phenolic resin, namely that supplied as "HRJ 2581" resin by Schenectady de France This is a thermoplastic zincated alkylphenolic resin supplied as a fine particle aqueous suspension of about 53.0 total solids content (48.4 active solids content i.e. resin solids content). As with resin "HRJ-4023", the resin is thought to be modified by the inclusion of a smal proportion of salicylic acid or a derivative thereof.

The procedural changes referred to above are as follows:

(a) the "Action" brand carbonless paper was unsized, i.e. different from that used in previous Examples.

(b) the laboratory coater was used to coat both surfaces of the paper sequentially (this, coupled with the fact that the paper was unsized, led to deep penetration of the size mix into the paper).

(c) the resin was included in the size press mix as a 54% solids mix (50% active solids) in an amount of 4.5%, (i.e. about 2.3% resin on a dry basis).

The results obtained were as follows:

| Time after Imaging | Contact with Adhesive (No/Yes) | Reflectance (%) Invention | D | Control | D |
|---|---|---|---|---|---|
| 1 min | No | 35 | | 38 | |
| | Yes | 38 | 3 | 42 | 4 |
| 2 min | No | 34 | | 37 | |
| | Yes | 37 | 3 | 41 | 4 |
| 5 min | No | 32 | | 36 | |
| | Yes | 36 | 4 | 40 | 6 |
| 2 hours | No | 30 | | 33 | |
| | Yes | 32 | 2 | 38 | 5 |
| 24 hours | No | 24 | | 30 | |
| | Yes | 28 | 4 | 37 | 7 |

It will be seen that the D values and final intensity values for the resin-containing paper are better than for the control paper.

EXAMPLE 8

The procedure of Example 5 was repeated using a further different phenolic resin, namely that supplied as "Durez" 31632 resin by Occidental Chemical Corporation. This is a zincated para-(tertiary octyl)phenol-formaldehyde resin supplied in flake rather than emulsion form. This resin is not thought to be modified by the inclusion of salicylic acid or a derivative thereof, and is of a type widely used in the manufacture of carbonless copying paper in the USA for many years.

The resin was first attrited to reduce its particle size to a level suitable for inclusion in a laboratory coating composition as described in previous Examples. Two different coating compositions were made up, differing in the amount of resin present. The amounts of resin used in the size press composition were 112.1 and 224.2 g respectively. The solids content of the resin was 44.6%, and the resin contents on a dry basis were therefore 3% and 6% by weight respectively.

The results obtained were as follows:

| Time after Imaging | Contact with Adhesive (No/Yes) | Reflectance % Invention (1) | D | Invention (2) | D | Control | D |
|---|---|---|---|---|---|---|---|
| 1 min | No | 36 | | 36 | | 37 | |
| | Yes | 38 | 2 | 37 | 1 | 41 | 4 |
| 2 min | No | 34 | | 35 | | 36 | |
| | Yes | 37 | 3 | 36 | 1 | 40 | 4 |
| 5 min | No | 33 | | 33 | | 34 | |
| | Yes | 35 | 2 | 34 | 1 | 38 | 4 |
| 15 min | No | 32 | | 32 | | 33 | |
| | Yes | 34 | 2 | 33 | 1 | 37 | 4 |
| 2 hours | No | 31 | | 31 | | 31 | |
| | Yes | 33 | 2 | 31 | 0 | 38 | 7 |
| 24 hours | No | 30 | | 29 | | 30 | |
| | Yes | 32 | 2 | 29 | 0 | 37 | 7 |

It will be seen that the D values and final intensity values for the resin containing paper were markedly better than for the control paper, particularly for the paper with the higher proportion of resin.

EXAMPLE 9

This illustrates the use of the resin used in Example 5 ("HRJ4023") but incorporated in the paper sheets by inclusion in the furnish from which the sheets were made, rather than by a subsequent coating operation.

The sheets were made by the procedure described in Example 1, using 0.4 g of acidic clay and 0.4 g of 35.7% solids content resin emulsion (other quantities being as in Example 1).

The sheets obtained were tested by the procedure described in previous Examples, and the results were as follows:

| Time after Imaging | Contact with Adhesive (No/Yes) | Reflectance (%) Invention | D | Control | D |
|---|---|---|---|---|---|
| 1 min | No | 44 | | 47 | |
| | Yes | 47 | 3 | 56 | 9 |
| 24 hours | No | 37 | | 42 | |
| | Yes | 41 | 4 | 58 | 16 |

It will be seen that the D values and final intensity values for the resin-containing paper were much better than for the control paper.

EXAMPLE 10

Example 9 was repeated using the resin used in Example 4 ("Durez 32131", as a 49.5% solids emulsion).

The results obtained were as follows:

| Time after Imaging | Contact with Adhesive (No/Yes) | Reflectance (%) Invention | D | Control | D |
|---|---|---|---|---|---|
| 1 min | No | 43 | | 47 | |
| | Yes | 46 | 3 | 56 | 9 |
| 24 hours | No | 35 | | 42 | |
| | Yes | 39 | 4 | 58 | 16 |

It will be seen that the D values and final intensity values for the resin-containing paper were much better than for the control paper.

EXAMPLE 11

Example 9 was repeated using the resin used in Example 6 ("SMD9910"), as a 54.9% solids emulsion).

The results obtained were as follows:

| Time after Imaging | Contact with Adhesive (No/Yes) | Reflectance (%) Invention | D | Control | D |
|---|---|---|---|---|---|
| 1 min | No | 45 | | 47 | |
| | Yes | 48 | 3 | 56 | 9 |
| 24 hours | No | 42 | | 42 | |
| | Yes | 47 | 5 | 58 | 16 |

It will be seen that the final intensity values were much better for the resin-containing paper, and that the D values also showed a significant improvement.

We claim:

1. A self-adhesive label assembly comprising self-adhesive label material peelably adhered to pressure-sensitive self-copying paper of which the image-generating reactants are:

(a) electron donating colour former material contained in microcapsules which are present as a loading within the thickness of the paper; and (b) an acidic colour developing material; characterized in that the acidic colour developing material comprises a phenol-formaldehyde resin.

2. A self-adhesive label assembly as claimed in claim 1, wherein the phenol of the phenol-formaldehyde resin is an alkyl- or phenyl- substituted phenol.

3. A self-adhesive label assembly as claimed in claim 1, wherein the phenol-formaldehyde resin is modified by the presence of a minor proportion of salicylic acid or a derivative thereof.

4. A self-adhesive label assembly as claimed in claim 1, wherein the phenol-formaldehyde resin is zincated.

5. A self-adhesive label assembly as claimed in claim 1 wherein the acidic colour developing material additionally comprises an acid clay colour developing material.

6. A self-adhesive label assembly as claimed in claim 5 wherein the self-copying paper contains from 5.5 to 6.5% of acid clay on a dry basis based on the dry weight of the paper.

7. A self-adhesive label assembly as claimed in claim 1 wherein the self-copying paper contains from 2.5 to 3.0% phenol-formaldehyde resin on a dry basis, based on the dry weight of the paper.

8. A self-adhesive label assembly as claimed in claim 7 wherein the self-copying paper contains from 5.5 to 6.5% of acid clay on a dry basis based on the dry weight of the paper.

* * * * *